US006929517B2

(12) United States Patent
Tsai

(10) Patent No.: US 6,929,517 B2
(45) Date of Patent: Aug. 16, 2005

(54) TERMINAL SEAT

(75) Inventor: Chih-Chung Tsai, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 10/740,474

(22) Filed: Dec. 22, 2003

(65) Prior Publication Data

US 2005/0064767 A1 Mar. 24, 2005

(30) Foreign Application Priority Data

Sep. 19, 2003 (TW) ..... 92216862 U

(51) Int. Cl.[7] ..... H01R 4/36

(52) U.S. Cl. ..... 439/810; 439/701; 439/533; 439/540.1; 439/527

(58) Field of Search ..... 439/701–710, 439/810, 533, 540.1, 527–529

(56) References Cited

U.S. PATENT DOCUMENTS 4,084,879 A * 4/1978 Lepow ..... 439/710
5,993,267 A * 11/1999 Lin ..... 439/709
6,361,374 B1 * 3/2002 Lloyd et al. ..... 439/701
D465,765 S * 11/2002 Zhang et al. ..... D13/147

* cited by examiner

*Primary Examiner*—Truc Nguyen
(74) *Attorney, Agent, or Firm*—Birch, Stewart, Kolasch & Birch, LLP

(57) ABSTRACT

A terminal seat comprises a first receiving portion, a second receiving portion and a joint portion formed between the two. The second receiving portion corresponds to the first receiving portion and has similar shapes. The joint portion formed between the first receiving portion and the second receiving portion has a smaller lateral cross-section and a smaller lengthwise cross-section than the first receiving portion and the second receiving portion so as to form an annular groove. A plurality of terminal seats can be assembled together by a fixing member. The fixing member crosses the annular groove and fastens the assembly of the plurality of terminal seats.

8 Claims, 7 Drawing Sheets

TERMINAL SEAT

This Nonprovisional application claims priority under 35 U.S.C. § 119(a) on Patent Application No(s). 092216862 filed in Taiwan on Sep. 19, 2003, the entire contents of which are hereby incorporated by reference.

BACKGROUND OF THE INVENTION

1. Field of the Invention

The invention generally relates to a terminal seat, and in particular relates to a terminal seat that is easy to be installed and easy to be made.

2. Related Art

Recently, electromechanical industries are well developed. Many kinds of components are being improved. For instance, the terminal seats that connect external power sources to internal electric components have also been developed and used.

The conventional terminal seats are used to be fixed by screws passing through some extrusions and holes formed on the seats. Since the space in a device for mounting the terminal seat is usually limited, when it is required to increase additional wire connections, additional terminal seats and space are difficult to be obtained. Because conventional terminal seats are made with a fixed number of terminals and mounting holes and require a certain space, additional terminal seats requires rearrangement of mounting space in the device, which is rather bothersome. Therefore, an improvement for solving the aforesaid problems of conventional terminal seats is necessary.

SUMMARY OF THE INVENTION

The object of the invention is to provide a terminal seat that can be dynamically piled up to increase the terminal numbers in correspondence to the requirement of wiring, and the whole terminal seat can be easily mounted and fixed.

A terminal seat according to the invention comprises a first receiving portion, a second receiving portion and a joint portion formed between the two. The second receiving portion corresponds to the first receiving portion and has similar shapes. The joint portion formed between the first receiving portion and the second receiving portion has a smaller lateral cross-section and a smaller lengthwise cross-section than the first receiving portion and the second receiving portion so as to form an annular groove. A plurality of terminal seats can be assembled together by a fixing member. The fixing member crosses the annular groove and fastens the assembly of the plurality of terminal seats. Adjacent terminal seats can be tightly assembled and save space. In comparison with conventional terminal seats, the terminal seat of the invention is compact, flexible and easy to use.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are limitative of the present invention, and wherein.

DETAILED DESCRIPTION OF THE INVENTION

Figure 1A:
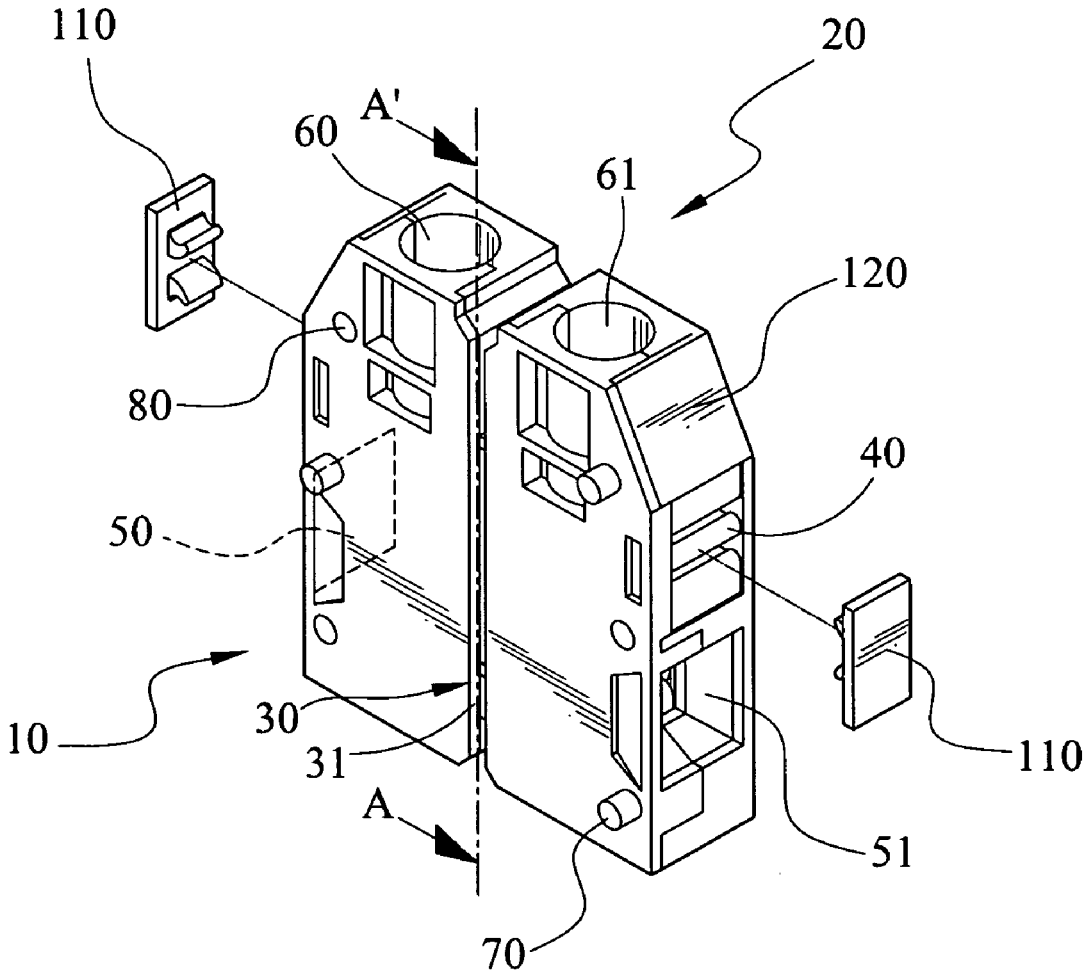
FIG. 1A is a perspective view of a terminal seat of the invention.
Figure 1B:
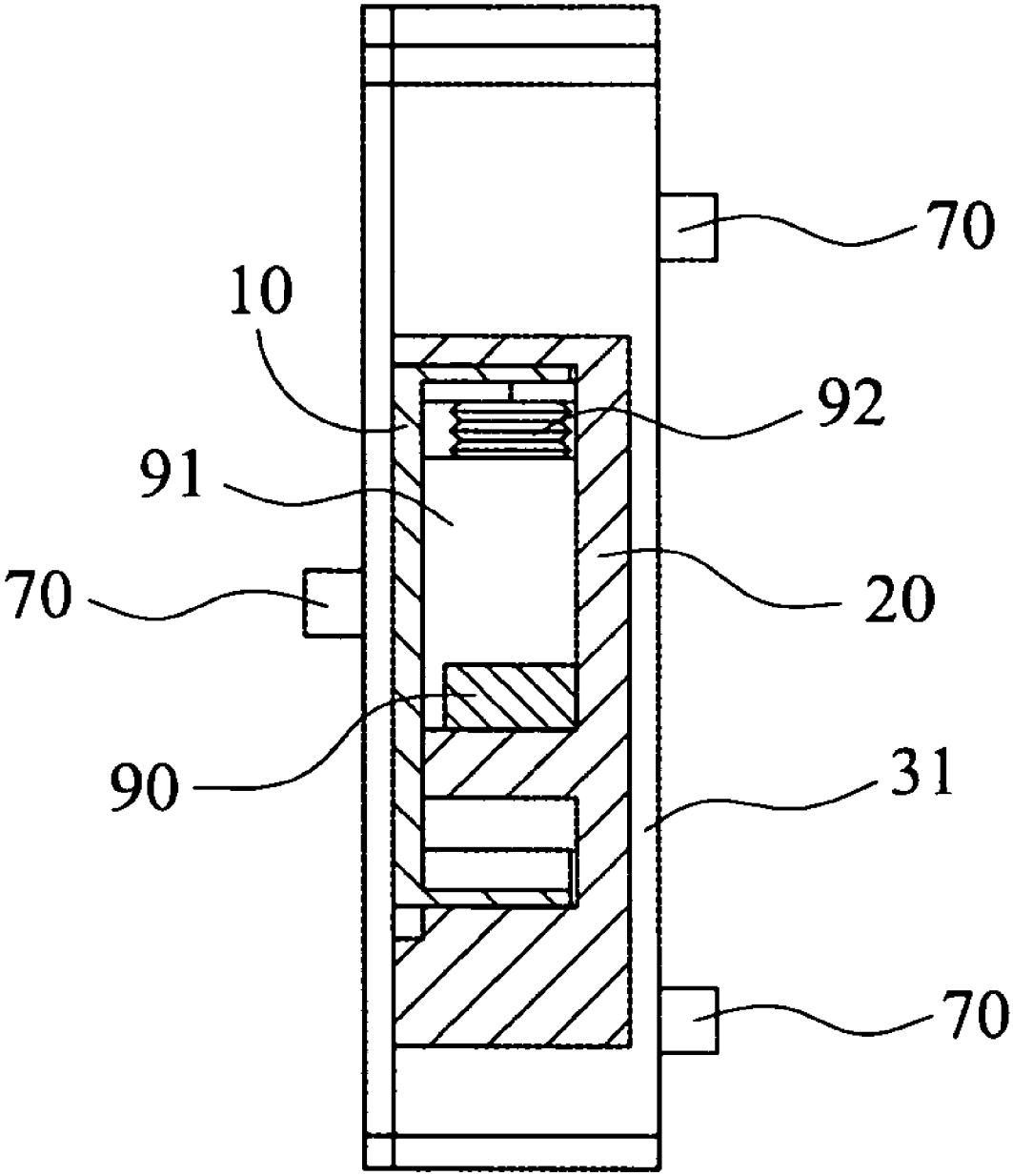
FIG. 1B is a sectional view taken along section A-A' of FIG. 1A.

As shown in FIG. 1A and FIG. 1B, a terminal seat according to the invention comprises a first receiving portion 10, a second receiving portion 20 and a joint portion 30 formed between the two. The second receiving portion 20 corresponds to the first receiving portion 10 and has similar shapes. The joint portion 30 formed between the first receiving portion 10 and the second receiving portion 20 has a smaller lateral cross-section and a smaller lengthwise cross-section than the first receiving portion 10 and the second receiving portion 20 so as to form an annular groove 31, as shown in FIG. 1B, which is a sectional view taken along middle section A-A' of FIG. 1A.

The first receiving portion 10 and the second receiving portion 20 are box-like members to be engaged with each other. The corners 120 can be used to have labels or prints (e.g. texts, numbers or icons) for identifications of wiring. There are also slots 40 formed on sides of the first and second receiving portions 10, 20 for mounting labeling badges 110 that carry texts, numbers or icons for identification. On the same sides of the slots 40 of the first and second receiving portions 10, 20, there are first connecting ports 50 and second connecting ports 51 for receiving external power lines or signal wires. A first hole 60 and a second hole 61 are also formed on top of the first and second receiving portions 10, 20. On sides of the first and second receiving portions 10, 20, there are correspondent extrusions 70 and holes 80 for engagement and positioning of adjacent terminal seats upon piling.

Figure 2:
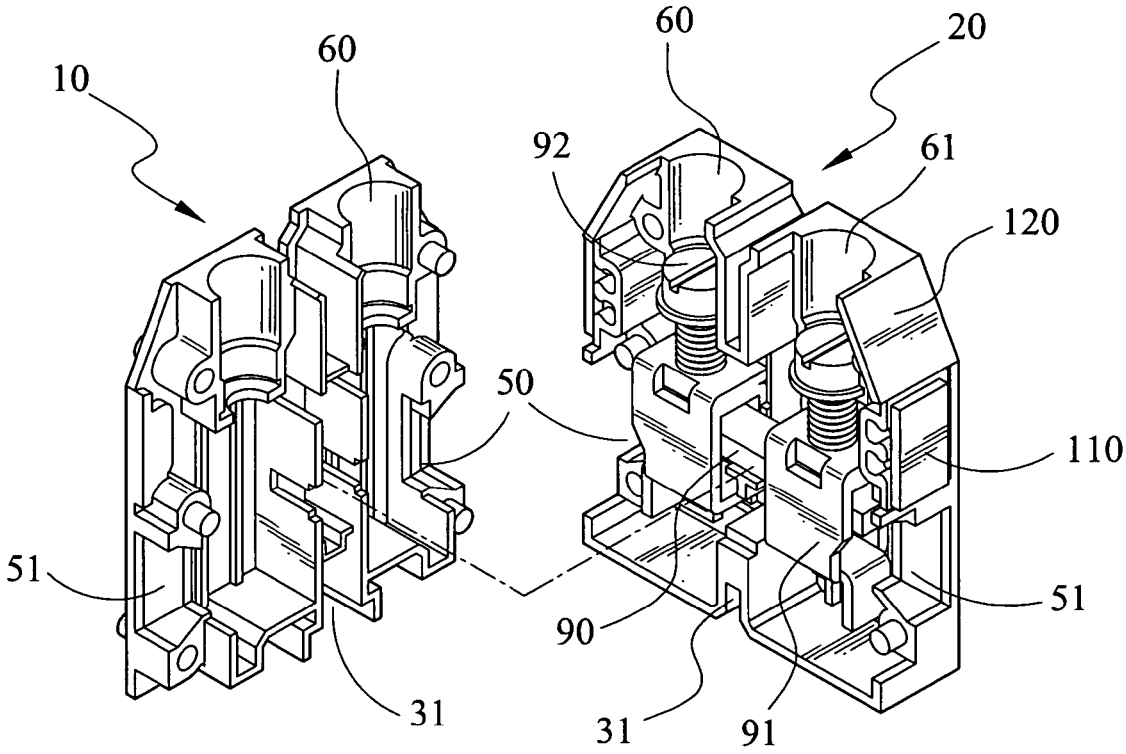
FIG. 2 is a disassembled component view of a terminal seat of the invention.
Figure 3:
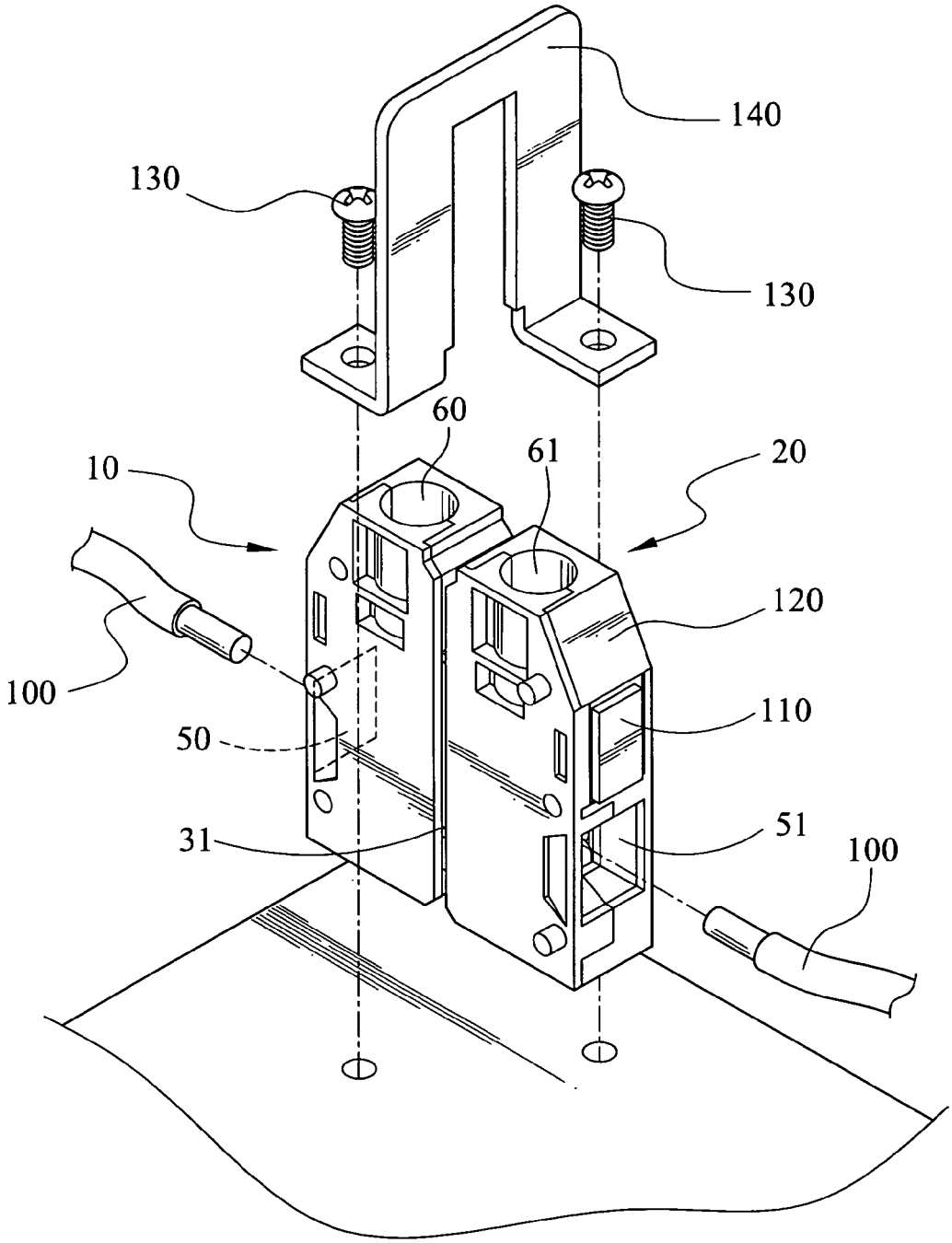
FIG. 3 is an application example of a terminal seat of the invention before fixing.

FIG. 2 shows internal structure of a terminal seat of the invention. In a device, a terminal seat is used to connect external power lines or signal wires to the internal power lines or signal wires of the device. Inside the cavity formed by the first and second receiving portions 10, 20, there are metal plates 90, fastening seats 91 and screws 92. Two fastening seats 91 are located in the first and the second connecting ports 50, 51 respectively. Two screws 92 are vertically mounted inside the first and second holes 60, 61 on top of the fastening seats 91. Both ends of the metal plate 90 extend to positions of the two fastening plates 91. As shown in FIG. 3, an external power line 100 passing through the first hole 60 is fixed to the fastening seat 91 by the screws 92 driven by a unshown driver. As the same, an internal power line 100 passing through the second hole 61 is fixed to the other fastening seat 91 by the other screw 92.

Figure 4:
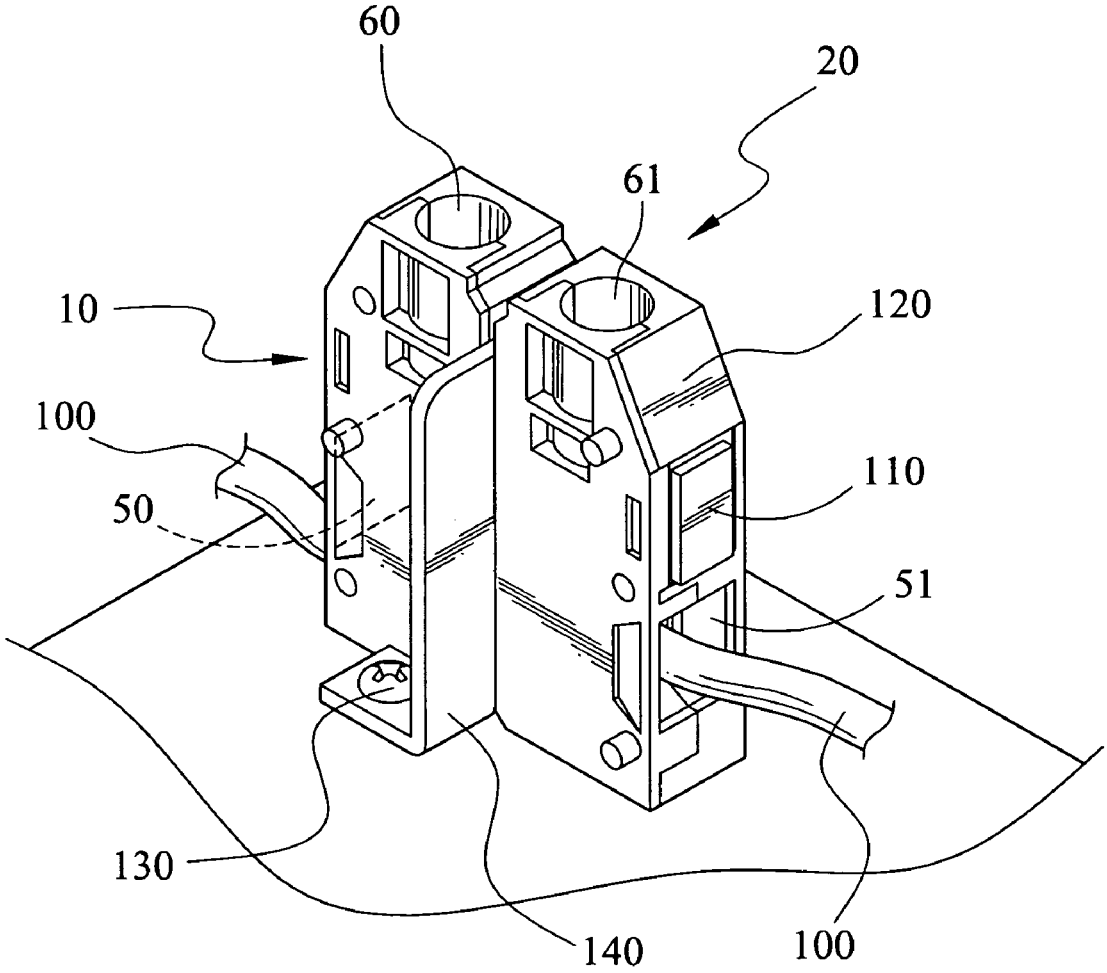
FIG. 4 is an application example of a terminal seat of the invention after fixing.

As shown in FIG. 4, when mounting, a U-shape fixing member 130 crosses the groove 31 and is fixed to the device by screws 140.

Figure 5:
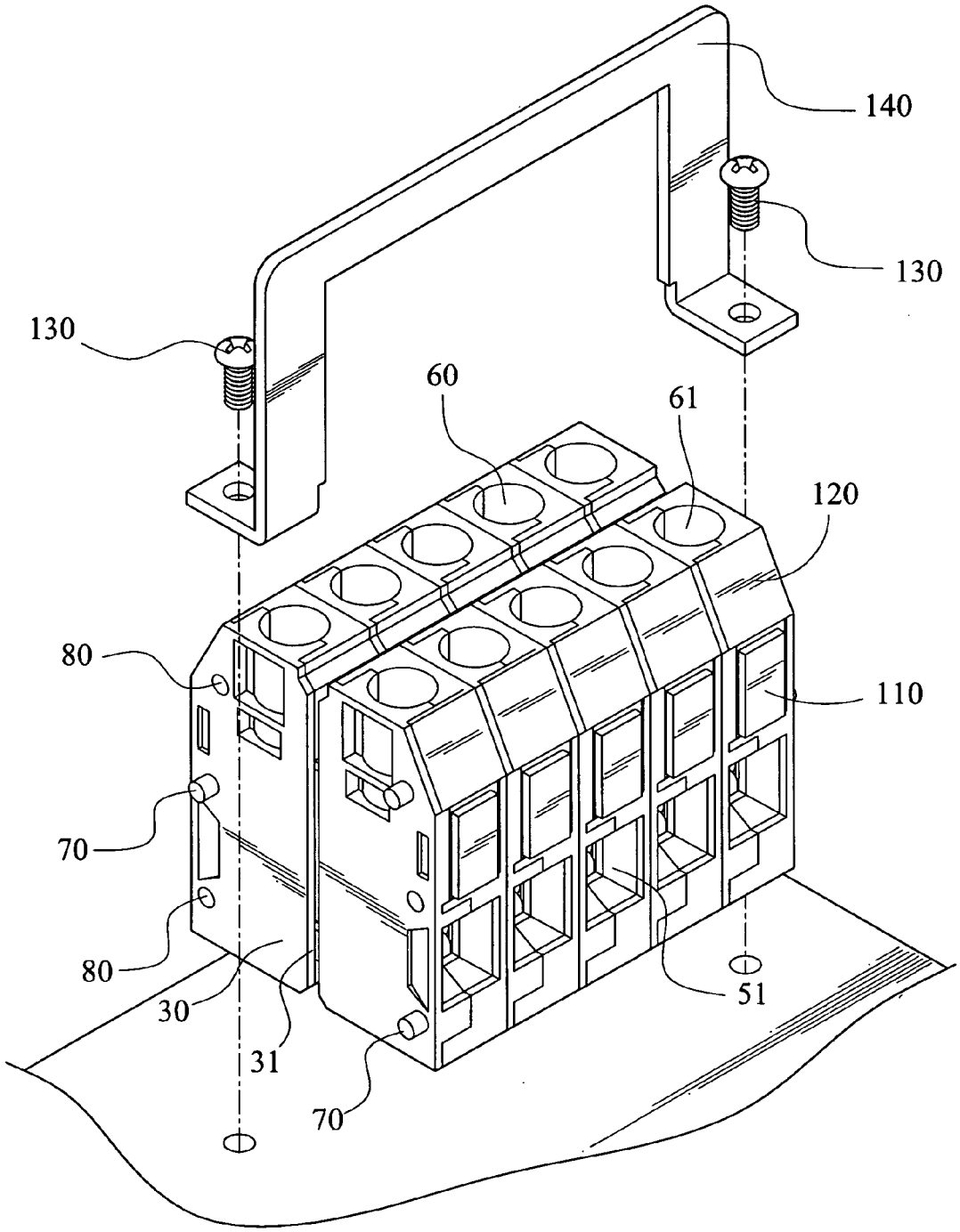
FIG. 5 is an application example of a plurality of terminal seats of the invention to be fixed.

A plurality of terminal seats of the invention can be piled up according to the requirements. Only a fixing member is needed for fastening and fixing the terminal seats. As shown in FIG. 5, each terminal seat has extrusions 70 correspondent to holes 80 of an adjacent terminal seat so that, upon being piled up, the terminal seats engages with each other. Finally, a fixing member 130 clamps on the grooves of the terminal seats, and is fixed to position by screws 140.

Figure 6:
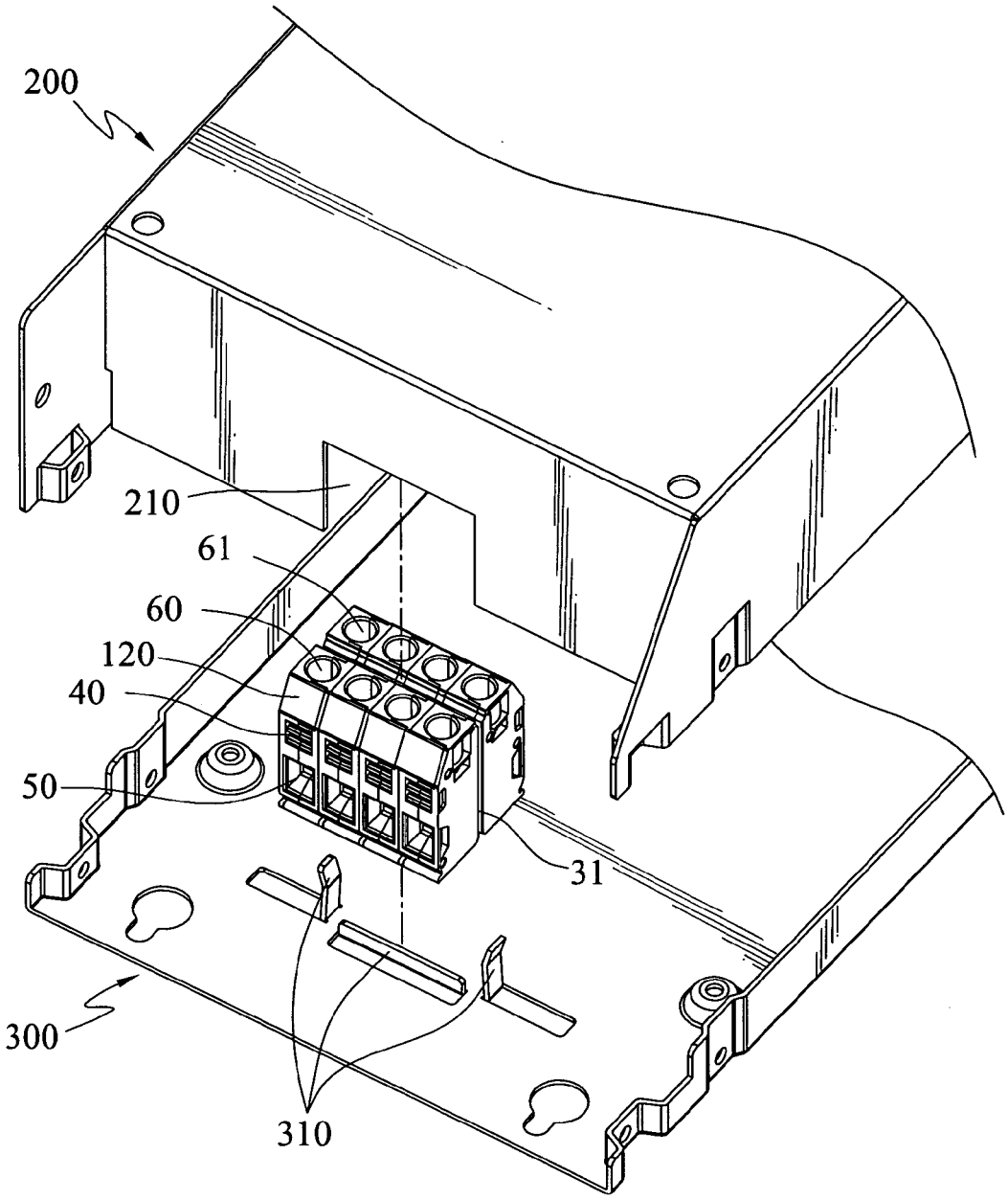
FIG. 6 is a further application example of a plurality of terminal seats of the invention to be fixed.

Besides using a fixing member to clamp a plurality of terminal seats, there are other ways to fix the terminal seats. For example, in FIG. 6, there are several terminal seats assembled and being fixed by an upper case 200 and a lower case 300. The upper case 200 has an opening 210 to be engaged with upper groove 31 of the terminal seats. The lower case 300 has bottom and side guides 310 to be engaged with bottom groove 31 and sidewalls of the terminal seat assembly. Therefore, upon assembling, the terminal seats are fixed by the upper and lower cases 200, 300.

The terminal seats of the invention can be piled up easily according to the requirements of terminal numbers. Adjacent terminal seats can be tightly assembled and save space. In comparison with conventional terminal seats, the terminal seat of the invention is compact, flexible and easy to use.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A terminal seat assembly, comprising:

a plurality of terminal seats each comprises: a first receiving portion and a correspondent second receiving portion, for receiving wires to be connected; and a joint portion, formed between said first and said second receiving portions, having a smaller lateral cross-section and a smaller lengthwise cross-section than said first and said second receiving portion so as to form an annular groove; and a fixing member for clamping on said groove and fastening said terminal seat assembly in position.

2. The terminal seat assembly according to claim 1 wherein one side of said first receiving portion is formed with a slot for an external labeling badge fitting in.

3. The terminal seat assembly according to claim 2 wherein said external labeling badge carries texts of identification.

4. The terminal seat assembly according to claim 1 wherein one side of each said first and each said second receiving portions are formed respectively with a plurality of extrusions and holes.

5. The terminal seat assembly according to claim 1 wherein one side of each said first and each said second receiving portions are formed respectively with a first connecting port and a second connecting port for receiving external wires.

6. The terminal seat assembly according to claim 1 wherein top of each said first and each said second receiving portions are formed with a first hole and a second hole.

7. The terminal seat assembly according to claim 1 wherein said fixing member is an U-shape member.

8. The terminal seat assembly according to claim 1 wherein said fixing member is made of metal.

* * * * *